US006363927B2

(12) United States Patent
Haynes et al.

(10) Patent No.: US 6,363,927 B2
(45) **Date of Patent: *Apr. 2, 2002**

(54) LOG BURNING DEVICE

(75) Inventors: Mark Edward Haynes, Portland, OR (US); Dave Roger Nelson, Brush Prairie, WA (US)

(73) Assignee: Byers Industries, Inc., Portland, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/548,481

(22) Filed: Apr. 13, 2000

(51) Int. Cl.[7] ..... F24B 1/193
(52) U.S. Cl. ..... 126/541; 126/152 B
(58) Field of Search ..... 126/152 B, 153, 126/160, 181, 298, 541; 431/125

(56) References Cited

U.S. PATENT DOCUMENTS

| | | | | |
|---|---|---|---|---|
| 3,508,536 A | | 4/1970 | McEwan | |
| 4,305,375 A | | 12/1981 | George | |
| 4,344,412 A | * | 8/1982 | Perrin | |
| 4,627,413 A | * | 12/1986 | Watson | 126/152 B |
| 4,838,781 A | | 6/1989 | Fischer | |
| 5,067,476 A | * | 11/1991 | Rhodes, Jr. | 126/152 B |
| 5,069,200 A | | 12/1991 | Thow et al. | |
| 5,074,284 A | | 12/1991 | LeLong et al. | |
| 5,118,539 A | | 6/1992 | Sebby et al. | |
| 5,423,310 A | | 6/1995 | Hudson et al. | |
| 5,435,295 A | | 7/1995 | Gerrard | |
| 5,722,390 A | * | 3/1998 | Hannebaum | 126/152 B |

* cited by examiner

*Primary Examiner*—Sara Clarke
(74) *Attorney, Agent, or Firm*—Miller Nash LLP

(57) ABSTRACT

A log burning device that includes a standing grate that supports at least one log and a cover that is attached by at least one hinge to the standing grate. A method for burning logs using a standing grate that has a hinged cover that is attached to the standing grate. The method includes the steps of rotating the cover to an open position, loading at least one log onto the standing grate, lighting the log, and then rotating the cover to a closed position.

24 Claims, 2 Drawing Sheets

LOG BURNING DEVICE

BACKGROUND OF THE INVENTION

This invention relates to log burning devices, and more particularly to racks used for firelogs to produce an effect similar to that of a wood fire.

Use of firelogs in place of wood logs is growing due to the ease in which firelogs are acquired, stored, and lighted. Firelogs were originally created to recycle sawdust; they burn with significantly fewer pollutants and emissions than natural firewood and are also made of recycled materials. Firelogs are also very popular because they produce less ash, carbon monoxide, and creosote than firewood, resulting in less chimney blockage. But firelogs do not create the same effect as that of a real wood fire. The difference between firewood and firelogs is noticeable.

Many attempts have been made to create burning devices that accommodate firelogs and simulate the appearance of a wood fire. U.S. Pat. No. 5,435,295 to Gerrard, U.S. Pat. No. 5,423,310 to Hudson, and U.S. Pat. No. 5,069,200 to Thow disclose burning devices exemplary of the state of the art. Significantly, all of these burning devices are poorly designed for replenishing a burning fire. The process for replenishing logs in these burning devices involves manually removing the hot artificial logs, adding a fresh firelog, and replacing the hot artificial logs. This complicated method requires a user to work extensively with fire and hot artificial logs, using cumbersome fire tools or even his own hands. This method is laborious and increases the risk of burns.

The burning device disclosed in the Gerrard patent includes a two-tiered rack: the lower tier is for supporting compressed paper logs, and the upper tier is for supporting artificial vacuum-formed ceramic logs. The lighted firelogs burn up through the artificial logs to give the ambience and appearance of a pile of real logs burning. As set forth above, to load firelogs onto a lighted fire, the user must remove the ceramic logs and eventually replace them.

The devices disclosed in the Hudson and Thow patents are for use with gas-fueled fireplaces. Both devices use artificial logs that are positioned individually to achieve the glowing appearance of a wood fire. This is poorly adaptable to firelogs because of the difficulty in replacing the artificial logs after a firelog has been lighted.

SUMMARY OF THE INVENTION

The log burning device of the present invention is easy to use and simulates a natural wood fire in both appearance and generation of heat. Because known burning devices are difficult to use, an easy-to-use burning device that can simulate a natural wood fire and generate a similar amount of heat is still needed. The present invention solves the problems of the aforementioned burning devices.

One preferred embodiment of the present invention is directed to a log burning device that includes a standing grate, which supports at least one log, and a cover attached by at least one hinge to the standing grate. In one preferred embodiment, the cover has the shape of at least one simulated log. When the log burning device contains a lighted firelog, it has the appearance of a burning wood fire.

Another preferred embodiment of the present invention is directed to a method for burning logs, which includes rotating a cover to an open position. A log is then loaded onto the fireplace standing grate and lighted. The cover is then rotated to a closed position.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
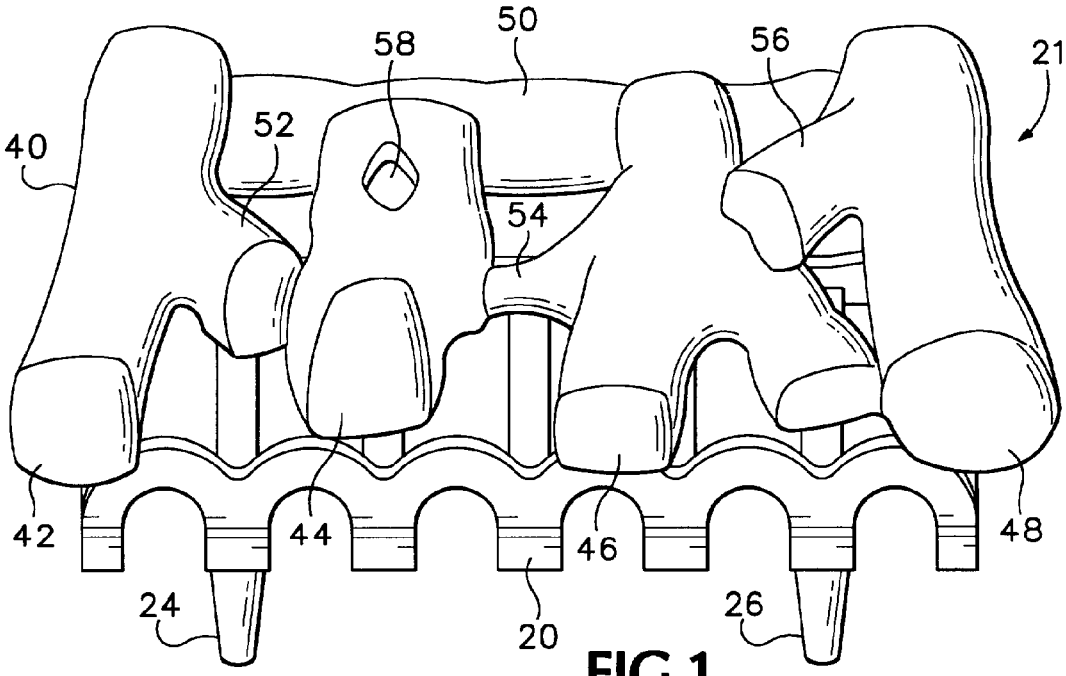
FIG. 1 is a perspective view of a log burning device of the present invention in a closed position.

Referring to the drawings, FIGS. 1–4 show a bottom portion or standing grate 20 of the log burning device 21 of the present invention. Preferably the standing grate 20 is suitable for holding at least one firelog 22. The standing grate 20 allows ash to fall through and contributes to airflow. A preferred embodiment of the standing grate 20 has two front legs 24, 26 and two rear legs 28, 30. Each rear leg 28, 30 curves upward to form an arm 32, 34 each with a hole (not shown) fitted for a hinge 36, 38. It should be noted that the shown standing grate is meant to be exemplary and that known standing grates, including but not limited to iron grates, an Eco-Fire grate, a self-feeding fire grate, or the log burning device disclosed in U.S. Pat. No. 4,344,412 to Perrin, may be substituted for the shown standing grate.

Referring to FIGS. 1–4, the upper portion of the invention is preferably a hinge-connected log cover 40. In the preferred embodiment, the hinged log cover 40 is in the shape of several small simulated logs 42, 44, 46, 48, 50. Simulated log 50 lies horizontally at the back of the hinged log cover 40 and is connected perpendicularly to simulated logs 42, 44, 46, 48. Simulated log 42 is connected to simulated log 44 by appendage 52. Simulated log 44 is connected to simulated log 46 by appendage 54. Simulated log 46 is connected to simulated log 48 by appendage 56. Simulated log 44 has a hole 58 (FIG. 1) that looks like knotted wood. The hole 58 and use of appendages 52, 54, 56 to connect simulated logs 42, 44, 46, 48 create cutouts. The hole 58, cutouts, and other openings allow for escape of smoke and flames and for sufficient airflow. It should be noted, however, that the hinged log cover 40 shown and described is meant to be exemplary. For example, more or fewer simulated logs 42, 44, 46, 48, 50 can be used depending on the size of the burning device and the effect desired. Further, the simulated logs 42, 44, 46, 48, 50 can be created in a stacked position to resemble a log pile. The simulated logs 42, 44, 46, 48, 50 can also be placed so that each would run the length of the cover. The cover can also be made in other decorative and novelty shapes.

Figure 2:
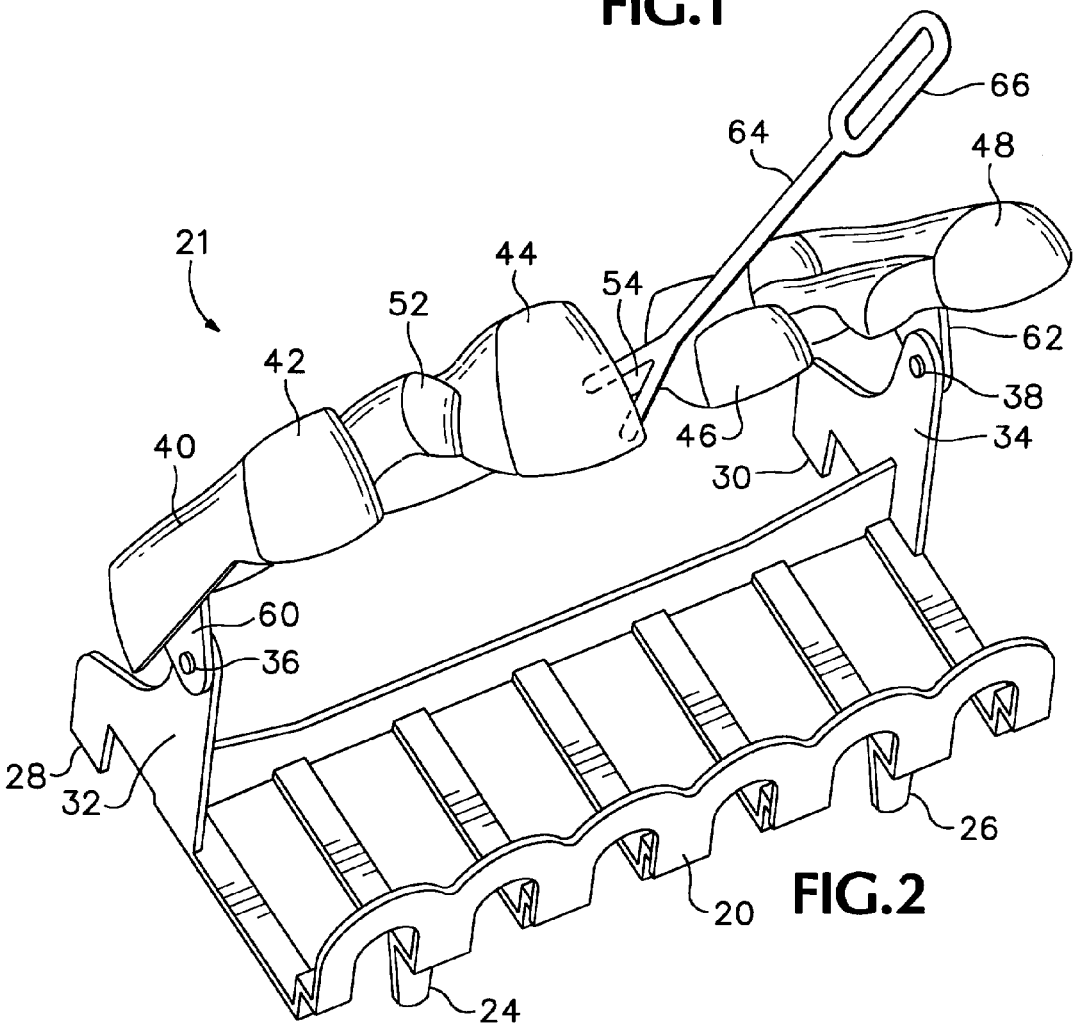
FIG. 2 is a perspective view of the log burning device of the present invention in an open position and of an exemplary opening tool.
Figure 3:
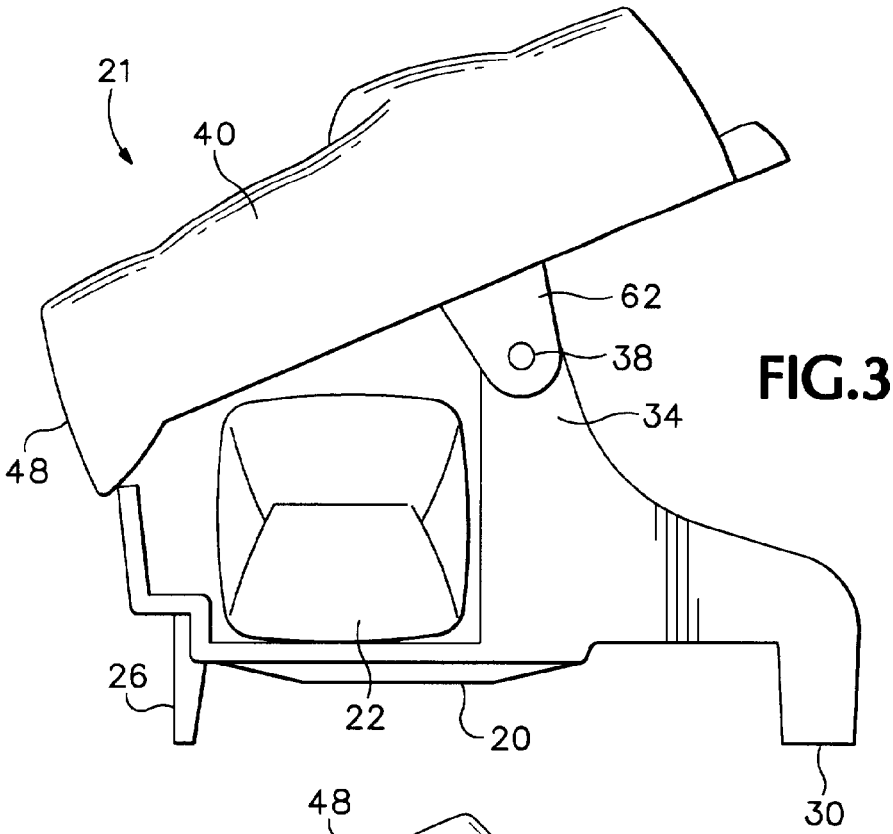
FIG. 3 is a side view of the log burning device of the present invention in a closed position with a firelog positioned therein.

Preferably, the hinged log cover 40 is placed substantially over the standing grate 20 and attached by hinge thereto. The right and left sides of the hinged log cover 40 (FIGS. 1 and 2) each have a downward-reaching arm 60, 62 with a hole (not shown) fitted for hinges 36, 38. In the shown embodiment, upward-reaching arm 32 is aligned with downward-reaching arm 60, and upward-reaching arm 34 is aligned with downward-reaching arm 62. Hinge 36 is inserted into the respective arm holes to connect upward-reaching arm 32 and downward-reaching arm 60. A hinge 38 is inserted into the respective arm holes to connect arms 34 and 62. Once the arms 32, 34, 60, 62 are connected, the hinged log cover 40 is connected to the standing grate 20 and is easily rotated to an open position (FIGS. 2 and 4) and to a closed position (FIGS. 1 and 3). Pins (not shown) can be attached to the hinges to secure the hinged log cover 40 to the standing grate 20. It should be noted that the shown hinges are meant to be exemplary and that known hinges, including but not limited to leaf springs, butt hinges, loose joint hinges, spring hinges, gas springs, or support hinges, may be substituted for the shown hinges. Also, the cover 40 could be hinged only on either the left or the right side so as to lift open to the right or left rather than from front to back. An alternative preferred embodiment would include a sliding cover.

Both the standing grate 20 and the hinged log cover 40 may be constructed from cast iron, metal, or other material able to withstand the heat of a log fire.

When rotated open, the hinged log cover 40 has an open position sufficient to allow at least one log to be inserted. In the preferred embodiment, the cover 40 can be rotated approximately 30° to 120° from the standing grate 20. In the closed position, the cover 40 is substantially parallel and adjacent to the standing grate 20.

An opening tool 64 (FIG. 2), similar to a fire poker, may be used to move the cover between the open position (FIGS. 2 and 4) and closed position (FIGS. 1 and 3). In the shown preferred embodiment, the opening tool 64 is forked and made of cast iron or other material able to withstand the heat of a fire. The exemplary opening tool 64 has a looped handle 66, making it easy to grasp. In the preferred embodiment, appendage 54 on the hinged log cover 40 provides a catch for the opening tool 64. It should be noted that the shown opening tool 64 is meant to be exemplary, and that known devices, including but not limited to fire pokers or fire tongs, could be substituted.

Figure 4:
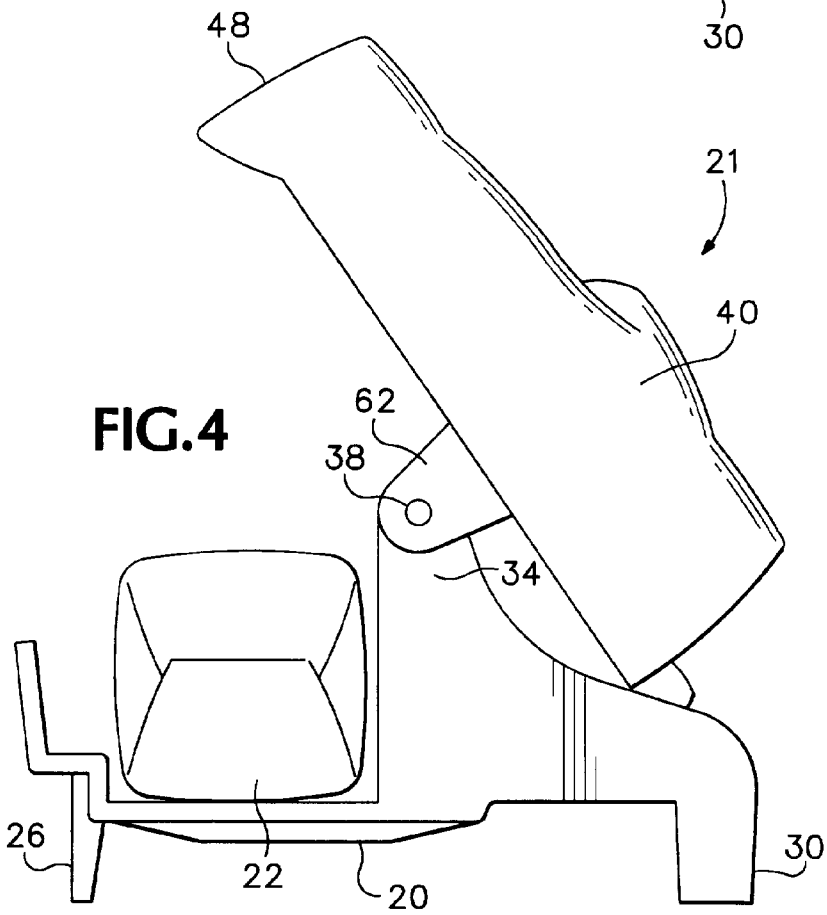
FIG. 4 is a side view of the log burning device of the present invention in an open position with a firelog positioned therein.

In use, the present invention is placed in a fireplace near a rear wall, allowing the invention to be opened and closed. The hinged log cover 40 is rotated to an open position (FIGS. 2 and 4), preferably using the opening tool 64 (FIG. 2). Next, at least one firelog 22 may be added to the standing grate 20 (FIGS. 3 and 4). Once the firelog 22 is lighted and has attained proper ignition, the opening tool 64 is used to rotate the hinged log cover 24 to a closed position (FIGS. 1 and 3). It is also possible to close the hinged log cover and then light the firelog. Flames and smoke escape through the openings of the hinged log cover 40, created by hole 58 and use of appendages 52, 54, 56, creating the appearance of a burning wood fire. To replenish a burning fire, the hinged log cover 40 is rotated to an open position (FIGS. 2 and 4), using the opening tool 64. At least one new firelog 22 is then inserted (FIGS. 3 and 4). The hinged log cover 40 is then rotated to a closed position (FIGS. 1 and 3) using the opening tool 64. This method of using the burning device of the present invention reduces the risk of burns because the user uses the opening tool 64 to rotate the hinged log cover 40. Further, because the shown hinged log cover 40 is a single unit, the user does not have to replace individual artificial logs, and thus the risk of burns is again reduced.

It should be noted that alternate preferred embodiments simulate, for example, the appearance of wood fires, burning coals, gas fires, debris fires, and other burnings.

The terms and expressions that have been employed in the foregoing specification are used as terms of description and not of limitation and are not intended to exclude equivalents of the features shown and described or portions of them. The scope of the invention is defined and limited only by the claims that follow.

What is claimed is:

1. A log burning device comprising:

(a) a standing grate for supporting at least one log;

(b) an integrally formed cover for blocking or diverting flames and for simulating a wood fire;

(c) at least one hinge mechanism;

(d) said cover attached directly to said at least one hinge mechanism;

(e) said at least one hinge mechanism attached directly to said standing grate.

2. The log burning device according to claim 1, wherein the standing grate and the cover are made from metal.

3. The log burning device according to claim 1, wherein the cover has the shape of at least one simulated log.

4. The log burning device according to claim 1, wherein the cover has at least one opening defined therein allowing for the escape of smoke and flames.

5. The log burning device according to claim 1, wherein the cover creates an appearance of a wood fire.

6. The log burning device according to claim 1, wherein the at least one log is at least one wood log.

7. The log burning device according to claim 1, wherein the at least one log is at least one firelog.

8. The log burning device according to claim 1, wherein the at least one log is at least one compressed paper log.

9. A log burning device comprising:

(a) a grate for supporting at least one log;

(b) an integrally formed cover having the permanent shape of at least one simulated log; and (c) said cover being attached directly to said grate by at least one fastening means that permits movement of said cover.

10. The log burning device according to claim 9, wherein the grate and the cover are made from metal.

11. The log burning device according to claim 9, wherein the cover is attached by at least one hinge to the grate.

12. The log burning device according to claim 9, wherein the cover has at least one opening defined therein allowing for the escape of smoke and flames.

13. The log burning device according to claim 9, wherein the cover creates an appearance of a wood fire.

14. The log burning device according to claim 9, wherein the at least one log is at least one wood log.

15. The log burning device according to claim 9, wherein the at least one log is at least one firelog.

16. The log burning device according to claim 9, wherein the at least one log is at least one compressed paper log.

17. A method for burning logs in a log burning device having a fireplace standing grate and an integrally formed cover of simulated logs, said cover hingedly attached to said grate, said method comprising the steps of:

(a) rotating said cover to an open position;

(b) loading at least one log onto said fireplace standing grate;

(c) rotating said cover to a closed position (d) lighting said at least one log to create flames; and (e) blocking or diverting a significant portion of said flames using said cover.

18. The method for burning logs of claim 17, wherein the step of rotating the cover open further includes the step of using an opening tool to rotate the cover.

19. The method for burning logs of claim 17, wherein the step of rotating the cover to a closed position further includes the step of using an opening tool to rotate the cover.

20. The method for burning logs of claim 17, further including the step of replenishing the at least one lighted log.

21. The method for burning logs of claim 17, wherein the step of replenishing further comprises the steps of:

(a) rotating the cover to an open position;

(b) loading at least one additional log onto the fireplace standing grate; and (c) rotating the cover to a closed position.

22. The method for burning logs of claim 17, wherein the step of rotating the cover to an open position further comprises the step of rotating the cover to at least 30° relative to the standing grate.

23. The method for burning logs of claim 17 wherein the step of rotating the cover to a closed position further comprises the step of rotating the cover so that the cover is substantially parallel and adjacent to the standing grate.

24. A log burning device comprising:

(a) a standing grate for supporting one log;

(b) a cover for substantially deflecting flames;

(c) said cover being a plurality of intregal formed simulated logs; and (d) said cover being movable between an open and closed position.

* * * * *